US012644594B2

(12) United States Patent
Correia et al.

(10) Patent No.: US 12,644,594 B2
(45) Date of Patent: Jun. 2, 2026

(54) BOILER TUBE INSERT AND BOILER TUBES HAVING INSERTS

(71) Applicant: The Cleaver-Brooks Company, Inc., Thomasville, GA (US)

(72) Inventors: Wilfred Correia, Pewaukee, WI (US); David Mikul, Richfield, WI (US); Joseph Wambach, Hales Corners, WI (US); Rakesh Zala, Germantown, WI (US)

(73) Assignee: The Cleaver-Brooks Company, Inc., Thomasville, GA (US)

( * ) Notice: Subject to any disclaimer, the term of this patent is extended or adjusted under 35 U.S.C. 154(b) by 326 days.

(21) Appl. No.: 18/138,391

(22) Filed: Apr. 24, 2023

(65) Prior Publication Data

US 2023/0349546 A1 Nov. 2, 2023

Related U.S. Application Data

(60) Provisional application No. 63/336,477, filed on Apr. 29, 2022.

(51) Int. Cl.
*F22B 37/06* (2006.01)
*F22B 7/12* (2006.01)

(52) U.S. Cl.
CPC ..... *F22B 37/06* (2013.01); *F22B 7/12* (2013.01)

(58) Field of Classification Search
CPC .. F22B 37/06; F22B 7/12; B22D 17/24; F28F 19/002; F28F 11/02; F28F 1/06; F28F 1/40; F28F 2001/027; F28F 1/08
See application file for complete search history.

(56) References Cited

U.S. PATENT DOCUMENTS 1,530,266 A * 3/1925 Huston ..... B23K 11/002 122/511
2,641,206 A * 6/1953 Minor ..... F22B 37/06 138/38

(Continued)

FOREIGN PATENT DOCUMENTS

CN 2089155 U * 11/1991
CN 106767025 5/2017

(Continued)

OTHER PUBLICATIONS

Saint-Gobain Ceramics & Plastics, SpyroCor Radiant Tube Inserts Informational Literature, 2019 (2 pages).

(Continued)

*Primary Examiner* — Gregory A Wilson
(74) *Attorney, Agent, or Firm* — Amundsen Davis, LLC

(57) ABSTRACT

Boiler systems having convection sections containing a set of boiler tubes having boiler tube inserts, boiler tubes for use in the convection section of a boiler system, and boiler tube inserts for boiler tubes for use in the convection section of a boiler system are provided herein. The boiler tube inserts are positioned in a first section of each boiler tube, where the first section extends from a front tube end the receives combustion gases from a furnace. The first section of the boiler tubes can be a plain tube section, and the boiler tubes can have a second section that includes a finned structure. The boiler tube inserts can be helical and can be made of a ceramic material.

20 Claims, 4 Drawing Sheets

(56) References Cited

U.S. PATENT DOCUMENTS

| | | | | |
|---|---|---|---|---|
| 2,895,508 | A * | 7/1959 | Drake | F28F 1/40 138/38 |
| 2,983,261 | A * | 5/1961 | William | F22B 9/04 122/218 |
| 3,636,982 | A * | 1/1972 | Drake | F28F 1/40 165/186 |
| 4,941,512 | A * | 7/1990 | McParland | F16L 55/163 29/523 |
| 6,484,795 | B1 | 11/2002 | Kasprzyk | |
| 6,971,336 | B1 * | 12/2005 | Chojnacki | F22B 7/12 122/76 |
| 8,162,040 | B2 * | 4/2012 | Briselden | F23L 15/04 165/142 |
| 9,938,146 | B2 * | 4/2018 | Lin | B01J 19/243 |
| 10,458,646 | B2 | 10/2019 | Vandegrift et al. | |
| 10,823,396 | B2 | 11/2020 | Nicolia et al. | |
| D910,829 | S | 2/2021 | Spadaccia et al. | |
| D910,830 | S | 2/2021 | Spadaccia et al. | |
| 2009/0050307 | A1 * | 2/2009 | Franke | F22B 29/06 219/628 |
| 2009/0277969 | A1 | 11/2009 | Briselden | |
| 2012/0193079 | A1 | 8/2012 | Briselden | |
| 2020/0049432 | A1 * | 2/2020 | Manay | F28D 1/04 |
| 2021/0180870 | A1 | 6/2021 | Briselden et al. | |

FOREIGN PATENT DOCUMENTS

| | | | | |
|---|---|---|---|---|
| CN | 107084391 | | 8/2017 | |
| CN | 207831343 | | 9/2018 | |
| CN | 110805901 | | 2/2020 | |
| EP | 2069692 | | 1/2019 | |
| JP | 5965170 | | 8/2016 | |
| JP | 6587411 | | 10/2019 | |
| JP | 6708909 | | 6/2020 | |
| JP | 2020115080 | | 7/2020 | |
| JP | 6790554 | | 11/2020 | |
| KR | 10-1301366 | | 8/2013 | |
| KR | 10-1995576 | | 8/2013 | |
| KR | 2000-0013776 | | 8/2013 | |
| TW | 201704712 | A * | 2/2017 | F28F 21/082 |

OTHER PUBLICATIONS

Mexican Patent Office (IMPI), Official Communication No. 30633 dated Mar. 26, 2026, issued in corresponding Mexican Application No. MX/a/2023/005026, 11 pages, including English summary appended.

* cited by examiner

BOILER TUBE INSERT AND BOILER TUBES HAVING INSERTS

FIELD OF THE INVENTION

The present technology relates to boiler systems that employ combustion processes, and more specifically to such boilers, boiler tubes having inserts and inserts for boiler tubes.

BACKGROUND

Inserts are frequently added to radiant tubes in heated energy systems, such as furnaces, boilers, and other systems that use radiant tubes. The advantages provided by inserts generally include enhanced fluid channeling, uniformity of heat transfer and radiation, the moderation of fluid flow and energy-producing reactions, the control and enhancement of energy-producing reactions, system structural enhancement, and increased system efficiency.

Inserts have been made in many shapes, although helical inserts are preferred in many applications. Helical inserts are typically positioned within heated energy systems to interact with and/or to be exposed to the products of energy generation, such as combusted hydrocarbon fuel, steam, hydrogen, nitrogen, carbon dioxide, and the products of catalytic reactions, subjecting the inserts to high temperature environments.

Radiant tube inserts used in boilers and other heated energy systems have been constructed of metal materials, such as stainless steel, and nickel-chrome alloy. One reason for this is that metals are easy to fabricate into helically twisted shapes, especially for simple, low twist geometries that allow the efficient exchanging of heat energy to a heat exchanging fluid flowing within the heat exchangers. However, metals exhibit far greater levels of thermal expansion and are limited with respect to the temperatures at which they can operate.

Ceramics have also been used as construction materials for radiant tube inserts due to the natural capability of ceramics to withstand high temperature environments. Ceramic inserts tend to be advantageous in that they generally experience less thermal expansion than other materials when subjected to significant temperature changes. The reduced thermal expansion rates of ceramics can also enhance the ability of an insert to match and couple with other system components, reducing thermally-induced stresses that can be associated with intercomponent couplings during high temperature operating conditions.

The optimum configuration of radiant tube inserts, with respect to shape and material, is strongly dependent upon the specific application. If heat produced by energy-producing reactions within a system is not properly radiated, captured or recycled due to an inefficiency of the radiant tube insert or of the system as a whole, an undue amount of energy may be lost and wasted or possibly result in a lack of control, economy, or operability of the system. Accordingly, with respect to radiant tube inserts characteristics such as the material, length, shape, and placement in the radiant tube, may all affect the operation and efficiency of the radiant tube insert. With respect to helical inserts, the specific characteristics of the shape also come into play, such as number of channels, depth of channels, twist angle, number of twists. Further, the characteristics of the radiant tubes also affects the operation of the system.

Further, tube inserts in other types of tubes in heated energy systems are not generally known, such as boiler tubes used for convective heat transfer instead of radiant heat transfer.

SUMMARY OF THE INVENTION

The present technology includes boiler tube inserts, boiler tubes having inserts, and boiler systems having boiler tubes that include boiler tube inserts.

In one aspect, a boiler system is disclosed that includes a housing, a furnace within the housing, the furnace including a rear wall, and a set of boiler tubes in a convection section of the boiler system. Each boiler tube of the set of boiler tubes includes a front tube end that receives combustion gases from the furnace, a rear tube end at which the combustion gases exit the boiler tube, and a first section that extends from the front tube end along at least a portion of a length of the boiler tube. Additionally, the first section of each boiler tube includes a boiler tube insert.

In another aspect, a boiler tube configured to be used in a convection section of a boiler system is provided. The boiler tube includes a front tube end configured to receive combustion gases from a furnace, and a rear tube end configured to allow the combustion gases to exit the boiler tube. The boiler tube also includes a first section that extends from the front tube end along at least a portion of a length of the boiler tube. Additionally, the first section includes a boiler tube insert.

In a third aspect, a boiler tube insert is provided that is configured to be retained in a boiler tube configured to be used in a convection section of a boiler system. The boiler tube insert includes a solid central core that extends along an entire length of the boiler tube insert, and a plurality of projections that each helically wrap around the solid central core in less than a full 360° rotation. Further, the boiler tube insert is made of a ceramic material.

BRIEF DESCRIPTION OF THE DRAWINGS

Specific examples have been chosen for purposes of illustration and description, and are shown in the accompanying drawings, forming a part of the specification.

DETAILED DESCRIPTION

The present technology relates to boiler tube inserts, boiler tubes having inserts, and boiler systems having boiler tubes that include boiler tube inserts. The present technology is particularly useful in boiler systems that have a furnace and employ combustion processes, such as boiler systems for hot water and steam applications.

Boiler systems that employ combustion processes to generate heat are commonly employed in a variety of environments. Fire tube boilers or boiler furnaces typically have a combustion chamber encompassed within a vessel or water tank and a convection section that includes a plurality of heat transfer tubes passing through the vessel for conducting heated or hot combustion gases resulting from combustion of an air-fuel mixture by a burner, typically located at the front of the boiler. The hot combustion gases are typically passed from the front of the boiler, to the rear, and back to the front. Additional passes, using additional tubes, can be provided within the boiler to accomplish complete heat exchange.

Figure 1:
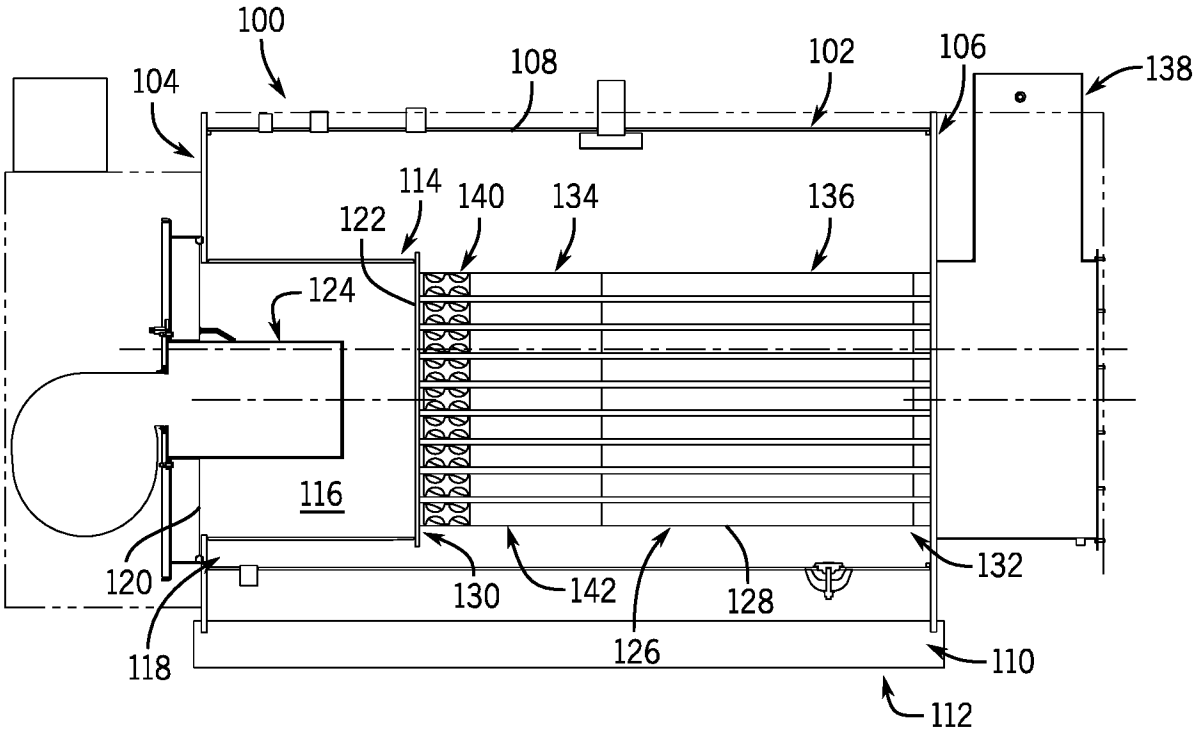
FIG. 1 is a schematic diagram of a boiler system in accordance with one example embodiment of the present technology.

One example of a boiler system 100 of the present technology is shown in FIG. 1. The boiler system 100 is a firetube boiler. The boiler system 100 has a housing 102, which can have a generally cylindrical shape having a circumference. The housing 102 can have a front end 104, rear end 106, top side 108 and bottom side 110. The housing 102 can be mounted on a base 112. Extending longitudinally (and as shown horizontally) within the housing 102 and generally near the bottom side 110 of the housing 102 is a main fire tube or furnace 114, which provides a combustion chamber 116 (FIG. 1). The combustion chamber 116 is generally bounded by a shell structure 118, which can have a cylindrical shape having a circumference. The shell structure 118 in the illustrated example extends longitudinally from a furnace front wall 120 to a furnace rear wall 122.

At or near the furnace front wall 120, the furnace 114 opens to accommodate a burner 124. At or near the furnace rear wall 122, the furnace 114 opens to a set of boiler tubes 126 in a convection section of the boiler system 100, which can be located rearward of the furnace 114 and which further extend longitudinally (and as shown horizontally) within the housing 102 of the boiler system 100, towards the rear end 106.

Each boiler tube 128 of the set of boiler tubes 126 is a convective boiler tube, configured to conduct convective heat transfer to transfer heat from the combustion gases of the furnace 114 to a medium such as water or steam. Each boiler tube 128 of the set of boiler tubes 126 can be straight. Each boiler tube 128 of the set of boiler tubes 126 can have a front tube end 130 that receives combustion gases from the furnace 114, and a rear tube end 132 at which the combustion gases exit the boiler tube 128. Each boiler tube 128 of the set of boiler tubes 126 can also have a first section 134 that extends from the front tube end 130 along at least a portion of the length of the boiler tube 128. Each boiler tube 128 of the set of boiler tubes 126 can further have a second section 136 that extends from the first section 134 to the rear tube end 132. In some examples, the first section 134 may be about half, or up to about half of the length of a boiler tube 128. In other examples, the first section 134 may be less than about half of the length of a boiler tube 128, such as being about one third or up to about one third of the length of a boiler tube 128.

In at least some examples, the first section 134 of a boiler tube 128 can be structured as a plain tube section. In other examples, the first section 134 of the boiler tube 128 may have a fireside extended surface, such as having a rifled surface. In at least some examples, the second section 136 of a boiler tube 128 can include a finned structure that extends along at least a portion of the length of the second section, and may extend up to the entire length of the second section. The finned structure can be formed from an aluminum alloy. In some examples, the entire tube, including the first section 134 and the second section 136, may be rifled. In other examples, the first section 134 may be plain and the second section 136 may be rifled.

After leaving the furnace 114, combustion gases enter the set of boiler tubes 126, wherein the combustion gases cool by transferring heat via convective heat transfer through the set of boiler tubes 126 to the water or steam medium. Combustion gases from the furnace 114 enter each boiler tube 128 of the set of boiler tubes 126 at the tube front end 130, travel through first section and the second section, and then exit the boiler tube 128 at the rear tube end 132. In the illustrated example, the combustion gases may leave each boiler tube 128 and exit the boiler system through a flue gas outlet 138. At the tube front end, the combustion gases can have a temperature in the range of about 1600° F. to about 2000° F., such as being about 1800° F.

As shown in FIG. 1, the first section 134 of each boiler tube 128 includes a boiler tube insert 140. The boiler system 100 can thus include a boiler tube insert 140 positioned within the first section 134 of each boiler tube 128. In at least some examples, each boiler tube insert 140 may be located in a front portion 142 of the first section 134 of the boiler tube 128. The front portion 142 of the first section of the boiler tube 128 starts at the front tube end 130 and extends along at least a portion of the length of the first section 134. In some examples, the front portion 142 may be about half, or up to about half of the length of the first section 134 a boiler tube 128. In other examples, the front portion 142 may be less than about half of the length of the first section 134 of a boiler tube 128, such as being about one third, or up to about one third of the length of the first section 134 of a boiler tube 128.

Figure 2:
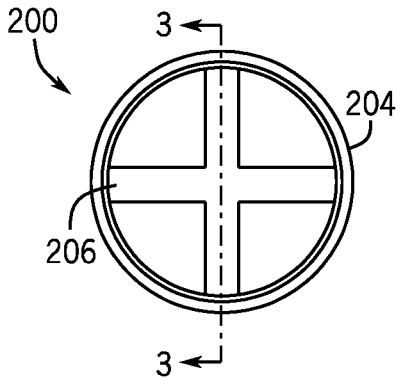
FIG. 2 is an end view of one example of a boiler tube of the present technology that can be used in the boiler system of FIG. 1.
Figure 3:
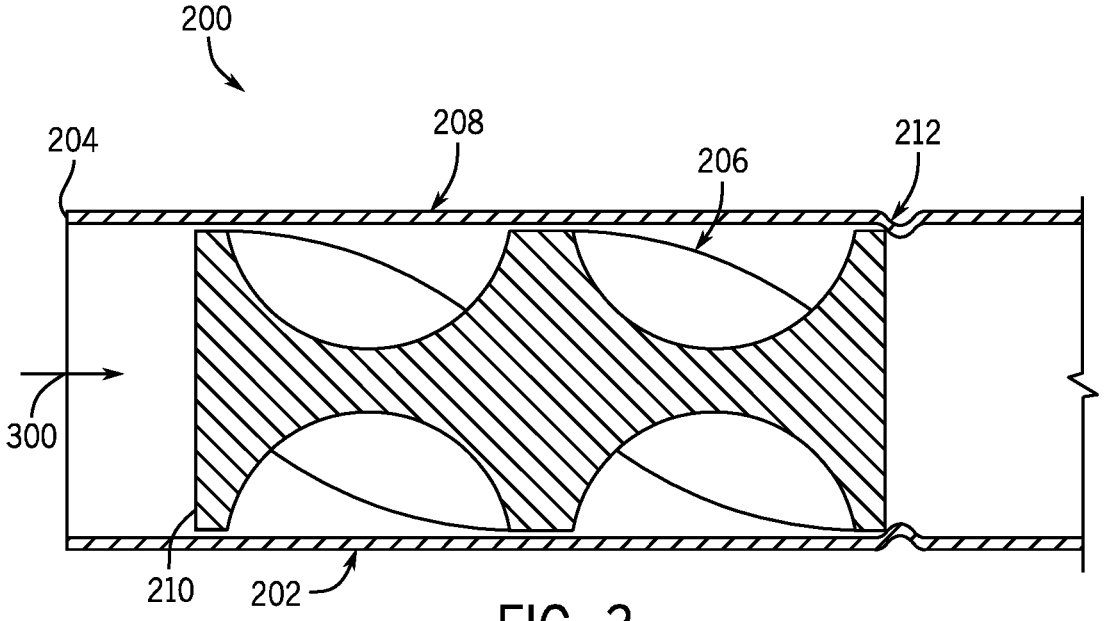
FIG. 3 is a cross-sectional side view of a portion of the boiler tube of FIG. 2, taken along line 3-3 of FIG. 2.
Figure 4:
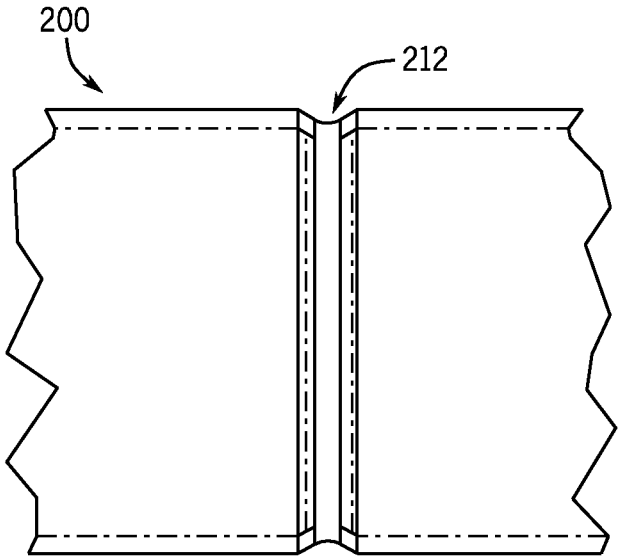
FIG. 4 is an external side view of a portion of the boiler tube of FIG. 3.

FIG. 2 is an end view of one example of a boiler tube 200 of the present technology, which can be used as a boiler tube 128 in boiler system 100 shown in FIG. 1. FIG. 3 is a cross-sectional view of a portion of the first section 202 of the boiler tube 200, taken along line 3-3 of FIG. 2, and FIG. 4 is an external side view of the portion of the first section 202 of the boiler tube 200. The boiler tube 200 has a front tube end 204, which is configured to receive combustion gases 300 from a furnace, such as furnace 114 of FIG. 1. Although not shown in FIGS. 2 and 3, the boiler tube 200 also includes a rear tube end, such as rear tube end 132 in FIG. 1, which is configured to allow the combustion gases 300 to exit the boiler tube 200.

The first section 202 extends from the front tube end 204 along at least a portion of the length of the boiler tube, and includes a boiler tube insert 206. As shown in the example illustrated in FIGS. 2 and 3, the first section 202 is a plain tube section, and the boiler tube insert 206 is located in a front portion 208 of the first section 202 of the boiler tube 200. The front portion 208 of the first section 202 of the boiler tube 202 extends from the front tube end 204 along at least a portion of the length of the first section 202, as discussed above with respect to front portion 142 of boiler tube 128. While the exact position of the boiler tube insert within the front portion 208 may vary depending upon the length and design of the boiler tube 200, the boiler tube insert is preferably positioned near the front tube end 204. In some examples, the boiler tube insert may be positioned such that the first end 210 of the boiler tube insert is positioned within about, or up to about, one foot of the front tube end 204, or within about, or up to about, 6 inches of the front tube end 204. In at least one example, the boiler tube insert may be positioned such that the first end 210 of the boiler tube insert is positioned within about, or up to about, 2 inches of the front tube end 204.

During manufacture or installation, the boiler tube insert 206 may be placed into the boiler tube 200 by sliding the boiler tube insert 206 into the boiler tube 200. Accordingly, the boiler tube insert can have diameter that is less than, or up to about, the inner diameter of the boiler tube 200, and can be configured to be slidably received within the boiler tube 200. The boiler tube 200 can include at least one indentation 212 configured to retain the boiler tube insert 206 at the desired location within the boiler tube 200. The indentation 212 as shown in FIGS. 3 and 4 is a circumferential groove, and extends around the entire circumference of the boiler tube 200. In some other examples, one or more indentations may be provided that have a shorter length, and may extend along only a portion of the circumference of the boiler tube 200. Alternatively, the boiler tube may include at least one other type of retention feature to retain the boiler tube insert 206 at the desired location within the boiler tube 200. The at least one retention feature is preferably configured to retain the boiler tube insert 206 at the desired location within the front portion 208 of the first section 202 of the boiler tube 200 during operation, when the combustion gases 300 apply force against the boiler tube insert 206 as they flow downstream through the boiler tube 200.

Figure 5:
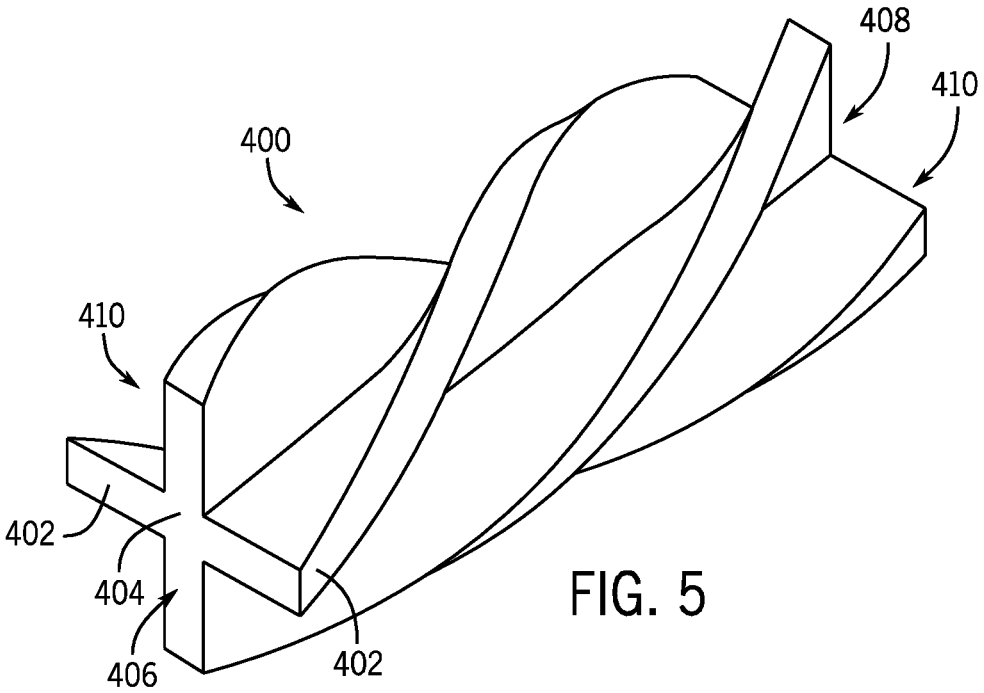
FIG. 5 is a front perspective view of a boiler tube insert of the present technology for use in a boiler tube, such as any of the boiler tubes of FIGS. 2-4.
Figure 6:
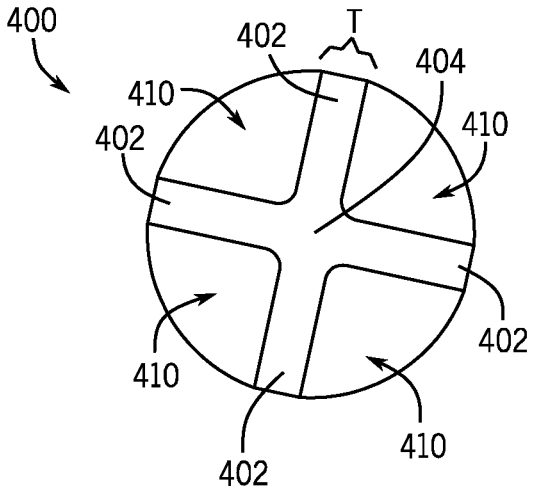
FIG. 6 is an end view of the boiler tube insert of FIG. 5.
Figure 7:
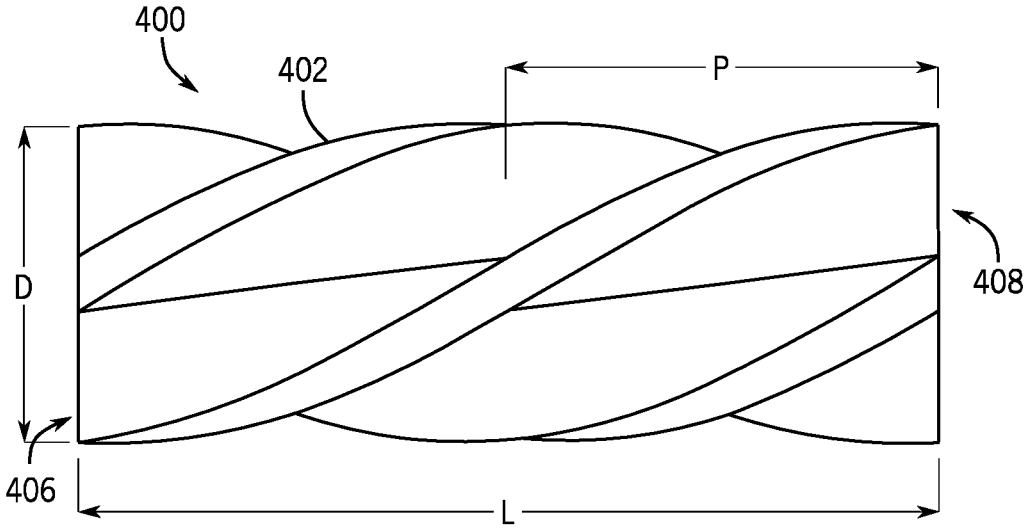
FIG. 7 is a side view of the boiler tube insert of FIG. 5.

FIGS. 5-7 illustrate one example of a boiler tube insert 400, which can be used as a boiler tube insert 140 in the boiler tube system 100, or boiler tube insert 206 of boiler tube 200. The boiler tube insert 400 is generally helical in shape, and has a plurality of projections 402, which are formed projections that each extend radially outward from and longitudinally along the central core 404. Each of the projections 402 also each helically wraps around, or bends around, the central core 404. The projections 402 form a helical channel 410, or passageway, between each pair of projections 402, and the combustion gases flowing through the boiler tube can flow along each of those channels 410.

The boiler tube insert 400 has a first end 406 and a second end 408, and a length that extends from the first end 406 to the second end 408. The boiler tube insert 400 has a length L, which can be any suitable length, and in some examples is from about 1 inch to about 20 inches, such as from about 4 inches to about 8 inches. In at least one example, the length of a boiler tube insert 400 may be about 6 inches. The boiler tube insert 400 has a diameter D that is less than the length of the boiler tube insert 400, and, as discussed above, can be less than, or up to about, the inner diameter of the boiler tube 200. For example the diameter of the boiler tube insert 400 can be from about 1 inches to about 4 inches, such as being about 3 inches.

In the example illustrated in FIGS. 5-7, the boiler tube insert 400 has four projections 402. In other examples, the boiler tube insert may have any suitable number of projections. For example, the boiler tube insert may have up to six projections, including having 2, 3, 4, 5, or 6 projections. Each of the projections 402 has a thickness T, which may be at least about 0.25 inches.

The central core 404 is solid and extends along the entire length of the boiler tube insert 400. Each of the projections 402 can helically wrap, extend, or bend around the central core 404 in an arc. The angle of the arc may depend upon the length of the boiler tube insert 400, and in at least some examples may be less than a full 360° arc. In the illustrated example, the arc formed by of each projection 402 around the central core 404 is from about 135° to about 225°, such being about 180°, or up to about 180°. The pitch P, which is the distance between any two consecutive peaks of the projections, may vary depending upon the length of the boiler tube insert 400 and the number of projections 402.

The boiler tube insert 400 can be made of a ceramic material configured to withstand combustion gas temperatures in the range of at least about 800° F. to at least about 2000° F. The ceramic material can include silicon carbide (SiC), and can include up to about 80% by weight of silicon carbide. The ceramic material may also include other materials such as aluminum oxide ($Al_2O_3$), silicon dioxide ($SiO_2$), calcium oxide (CaO), ferric oxide ($Fe_2O_3$), alkalies, and other materials. The ceramic material can be porous, and can have a porosity from about 8.0% to about 14%, such as from about 9% to about 10%, or from about 13% to about 14%.

It should be understood that, while the boiler systems shown in the illustrated examples have horizontally oriented tubes, boiler tubes having inserts of the present technology may have any suitable orientation, such as being horizontal, vertical, or inclined at any angle.

The use of boiler tube inserts in boiler tubes and boiler systems in accordance with the present technology may provide advantages over various other boiler systems and boiler tubes. For example, in a boiler systems using boiler tubes having a finned structure formed from an aluminum alloy, but no boiler tube insert, the flow rate of the combustion gases has to be reduced in order to prevent overheating of the aluminum. In contrast, in boiler tubes of the present technology, the ceramic insert may increase the convective heat transfer of the boiler tube, particularly in the first section of the boiler tube. Increased heat transfer in the first section of the boiler tube may reduce the temperature of the combustion gases before they reach the aluminum finned structure sufficiently that the flow rate of the combustion gases does not have to be reduced. For example, testing has indicated that the flow rate in boiler tubes of the present technology may be increased by about 50%, as compared to boiler tubes that are identical but do not include a boiler tube insert of the present technology. Additionally, increased convective heat transfer within boiler tubes of the present technology may allow for boiler systems having a smaller footprint, as well as reduced manufacturing, shipping and installation costs.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A boiler system comprising:

a housing;

a furnace within the housing, the furnace including a rear wall; and a set of boiler tubes in a convection section of the boiler system;

wherein each boiler tube of the set of boiler tubes includes a front tube end that receives combustion gases from the furnace, a rear tube end at which the combustion gases exit the boiler tube, a first section that extends from the front tube end along at least a portion of a length of the boiler tube, and a second section that extends from the first section to the rear tube end;

wherein the first section of each boiler tube of the set of boiler tubes includes a boiler tube insert that includes a central core that extends along an entire length of the boiler tube insert, and a plurality of projections that each helically wrap around the central core in less than a full 360° arc.

2. The boiler system of claim 1, wherein each boiler tube of the set of boiler tubes is straight.

3. The boiler system of claim 1, wherein the first section of each boiler tube of the set of boiler tubes is a plain tube section.

4. The boiler system of claim 1, wherein the boiler tube insert is positioned in a front portion of the first section, wherein the front portion starts at the front tube end and extends along at least a portion of a length of the first section.

5. The boiler system of claim 4, wherein the front portion is up to about half of the length of the first section.

6. The boiler system of claim 1, wherein each boiler tube includes at least one indentation configured to retain the boiler tube insert within the boiler tube.

7. The boiler system of claim 1, wherein the boiler tube insert comprises:

a solid central core;

wherein the boiler tube insert is made of a ceramic material.

8. The boiler system of claim 7, wherein:

the plurality of projections consists of a from two projections to six projections;

each of the plurality of projections helically wraps around the solid central core in an arc that is from about 135° to about 225°; and a length of the boiler tube insert is from about 1 inches to about 20 inches.

9. A boiler tube configured to be used in a convection section of a boiler system, the boiler tube comprising:

a front tube end configured to receive combustion gases from a furnace;

a rear tube end configured to allow the combustion gases to exit the boiler tube; and a first section that extends from the front tube end along at least a portion of a length of the boiler tube and a second section that extends from the first section to the rear tube end, wherein the first section includes a boiler tube insert that includes a central core that extends along an entire length of the boiler tube insert, and a plurality of projections that each helically wrap around the central core in less than a full 360° arc.

10. The boiler tube of claim 9, wherein the boiler tube is straight.

11. The boiler tube of claim 9, wherein the first section of the boiler tube is a plain tube section.

12. The boiler tube of claim 9, wherein the boiler tube insert is positioned in a front portion of the first section, wherein the front portion starts at the front tube end and extends along at least a portion of a length of the first section.

13. The boiler tube of claim 12, wherein the front portion is up to about half of the length of the first section.

14. The boiler tube of claim 9, wherein the boiler tube includes at least one indentation configured to retain the boiler tube insert within the boiler tube.

15. The boiler tube of claim 9, wherein the boiler tube insert comprises:

a solid central core;

wherein the boiler tube insert is made of a ceramic material.

16. The boiler tube of claim 15, wherein:

the plurality of projections consists of from two projections to six projections;

each of the plurality of projections helically wraps around the solid central core in a rotation that is from about 135° to about 225°; and the length of the boiler tube insert is from about 1 inches to about 20 inches.

17. A boiler system comprising:

a housing;

a furnace within the housing, the furnace including a rear wall; and a set of boiler tubes in a convection section of the boiler system;

wherein each boiler tube of the set of boiler tubes includes a front tube end that receives combustion gases from the furnace, a rear tube end at which the combustion gases exit the boiler tube, and a first section that extends from the front tube end along at least a portion of a length of the boiler tube;

wherein the first section of each boiler tube of the set of boiler tubes includes a boiler tube insert that includes a central core that extends along an entire length of the boiler tube insert, and a plurality of projections that each helically wrap around the central core in less than a full 360° arc; and wherein each boiler tube includes at least one indentation configured to retain the boiler tube insert within the boiler tube.

18. The boiler system of claim 17, wherein the boiler tube insert is positioned in a front portion of the first section of each boiler tube of the set of boiler tubes, wherein the front portion starts at the front tube end and extends along at least a portion of a length of the first section.

19. A boiler tube configured to be used in a convection section of a boiler system, the boiler tube comprising:

a front tube end configured to receive combustion gases from a furnace;

a rear tube end configured to allow the combustion gases to exit the boiler tube; and a first section that extends from the front tube end along at least a portion of a length of the boiler tube, wherein the first section includes a boiler tube insert that includes a central core that extends along an entire length of the boiler tube insert, and a plurality of projections that each helically wrap around the central core in less than a full 360° arc;

wherein the boiler tube includes at least one indentation configured to retain the boiler tube insert within the boiler tube.

20. The boiler tube of claim 19, wherein the boiler tube insert is positioned in a front portion of the first section, wherein the front portion starts at the front tube end and extends along at least a portion of a length of the first section.

* * * * *